US007467777B2

(12) United States Patent
Huber et al.

(10) Patent No.: US 7,467,777 B2
(45) Date of Patent: Dec. 23, 2008

(54) DEVICES FOR SECURING REINFORCING BARS WITHIN FORMS FOR CONCRETE

(75) Inventors: Donald G. Huber, Gig Harbor, WA (US); Terry Hartman, Tacoma, WA (US)

(73) Assignee: Quick Formz, LLC, Tacoma, WA (US)

( * ) Notice: Subject to any disclaimer, the term of this patent is extended or adjusted under 35 U.S.C. 154(b) by 213 days.

(21) Appl. No.: 10/929,854

(22) Filed: Aug. 30, 2004

(65) Prior Publication Data

US 2005/0055984 A1 Mar. 17, 2005

Related U.S. Application Data

(60) Provisional application No. 60/499,110, filed on Aug. 29, 2003.

(51) Int. Cl.
*E04G 17/12* (2006.01)

(52) U.S. Cl. ..... 249/214; 249/91; 249/218

(58) Field of Classification Search ..... 249/91, 249/83, 93, 4, 5, 208, 214, 216, 218
See application file for complete search history.

(56) References Cited

U.S. PATENT DOCUMENTS

| | | | | |
|---|---|---|---|---|
| 1,616,977 | A | 2/1927 | Koivu | |
| 4,190,999 | A | 3/1980 | Hampton | 52/687 |
| 4,644,726 | A | 2/1987 | Wheeler | 52/677 |
| 4,644,727 | A * | 2/1987 | Hanson et al. | 52/687 |
| 4,796,851 | A | 1/1989 | Brechbuehler | 249/91 |
| 4,888,931 | A * | 12/1989 | Meilleur | 52/426 |
| 5,174,083 | A * | 12/1992 | Mussell | 249/5 |
| 5,224,799 | A | 7/1993 | Parker | 405/229 |
| 5,240,224 | A | 8/1993 | Adams | 249/93 |
| 5,388,804 | A | 2/1995 | Cohen et al. | 249/210 |
| 5,390,459 | A * | 2/1995 | Mensen | 52/426 |
| 5,509,636 | A | 4/1996 | Cotugno | 249/91 |
| 5,688,428 | A | 11/1997 | Maguire | 249/91 |
| 5,852,907 | A * | 12/1998 | Tobin et al. | 249/216 |
| 5,937,604 | A | 8/1999 | Bowron | 52/426 |
| 6,047,515 | A | 4/2000 | Behlen | 52/699 |
| 6,141,937 | A | 11/2000 | Dressler | 52/742.1 |
| 6,161,360 | A | 12/2000 | Smith | 52/678 |
| 6,176,061 | B1 | 1/2001 | Smith | 52/719 |
| 6,240,688 | B1 | 6/2001 | Dressler | 52/295 |
| 2002/0092253 | A1 * | 7/2002 | Beliveau | 249/216 |

* cited by examiner

*Primary Examiner*—M. Safavi
(74) *Attorney, Agent, or Firm*—David L. Garrison; Merchant & Gould PC

(57) ABSTRACT

Devices for supporting horizontally oriented reinforcing bars in a form for concrete and devices for supporting vertically oriented reinforcing bars are disclosed herein. The devices for supporting horizontally oriented reinforcing bars (horizontal reinforcing bar) engage the side walls of a form, spans the space between the walls, and remains securely in position.

The device includes guide members for guiding reinforcing bar sections into a desired position, and members that secure the reinforcing bar in position. The devices for supporting vertically oriented reinforcing bars (vertical reinforcing bar) are used with a generally L-shaped section of reinforcing bar and secured to two parallel sections of horizontal reinforcing bar. The devices can be constructed from any material having properties that make the material satisfactory for use with concrete and provide sufficient strength to support the form side walls against deformation under hydrostatic pressure.

10 Claims, 5 Drawing Sheets

FIG.1
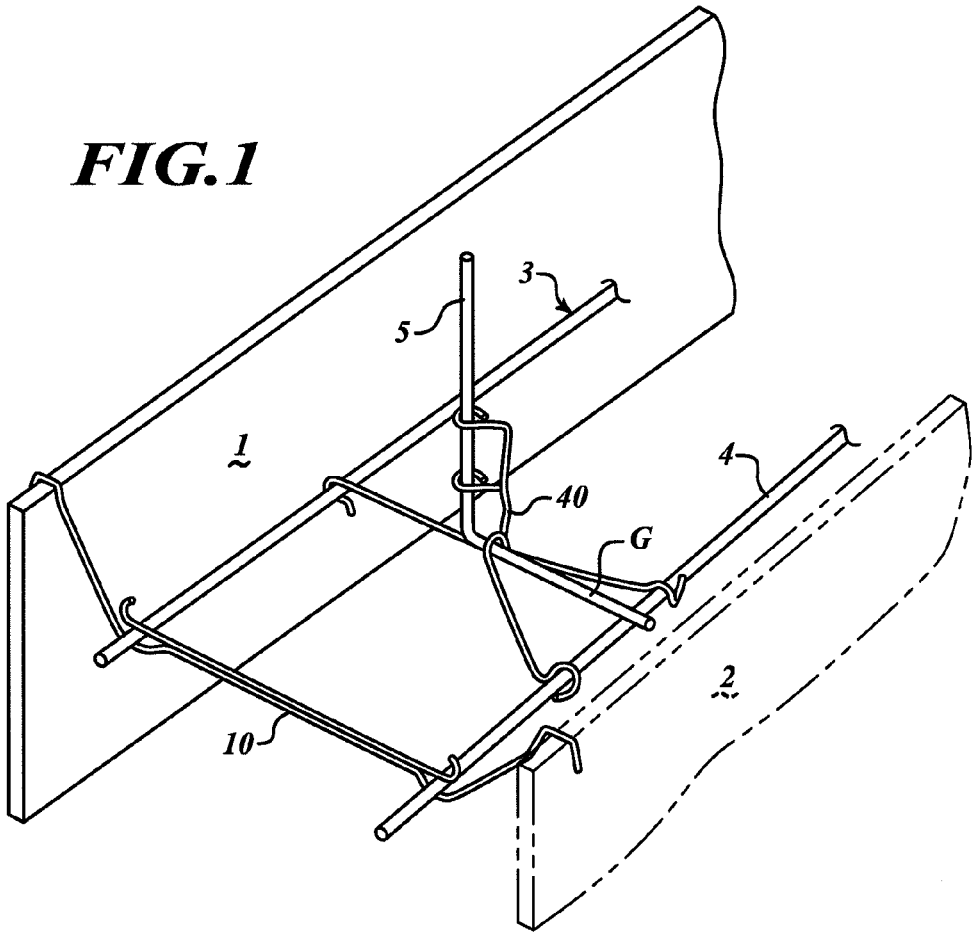
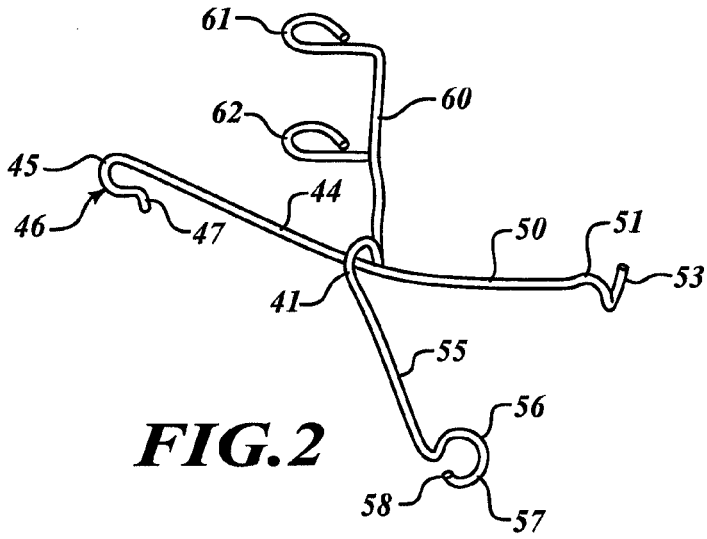
FIG.2

DEVICES FOR SECURING REINFORCING BARS WITHIN FORMS FOR CONCRETE

This application claims the benefit of U.S. Provisional Application Ser. No. 60/499,110, entitled DEVICE FOR SECURING REINFORCING BAR IN FOUNDATION FOOTING FORMS, filed Aug. 29, 2003.

TECHNICAL FIELD

This invention relates to concrete forms, and more particularly to devices for securing horizontally and vertically oriented reinforcing bars inside of concrete form walls.

BACKGROUND OF THE INVENTION

In the art of constructing buildings, it is common practice to cast the base or foundation with concrete. A trench or excavation channel is prepared into which the forms, either made from steel or wood, are set up adjacent and connected to each other matching the dimensions of the required foundation (footing). The forms, which are steel panels or wooden boards or planks, are put into position on their edges across from each other and parallel to each other near the side walls of the trench.

Steel reinforcement generally takes the form of reinforcing bars that are placed in the form in such a manner that the wet concrete completely covers the reinforcing bar. Horizontally oriented reinforcing bar is generally held in place by using separate reinforcing bar mounting stands. Some of the generally available reinforcing bar stands can be connected to the form after the form has been constructed, while others are positioned in the form and the reinforcing bar is placed on the device. Vertically oriented reinforcing bar is generally secured in the form by devices that are connected to the form after it is constructed. Placing the reinforcing bar securing devices in the desired location within the form requires additional labor and some degree of skill.

There are several devices in the prior art that can be used to secure vertically and horizontally oriented reinforcing bars inside of a concrete form. One such device is disclosed in U.S. Pat. No. 5,937,604, issued on Aug. 17, 1999, to Bowron. The Bowron patent discloses a form wall spacer in the configuration of a truss having top and bottom horizontal frame members interconnected by angularly extending reinforcing struts. The top frame member is configured to rest upon the upper edges of a pair of spaced concrete form walls, and end portions of the top frame member are extended downward for abutment by the outer sides of the spaced concrete form walls. A pair of spaced clip members are each configured to removably support a pair of lengths horizontally oriented reinforcing bars. A pair of vertically spaced reinforcing bar supports are mounted on the top and bottom frame members for frictionally securing a vertically extending length of reinforcing bar for forming a structural tie between a concrete footing and a vertically extending concrete wall.

Because of the way the device disclosed in the Bowron patent is structured, the horizontally oriented reinforcing bars must be either placed in the form prior to insertion of the spacer or placed into the spacer prior to placement of the spacer into the form. Additionally, the horizontally oriented reinforcing bars must be exactingly placed in snaps that are located on the bottom of the spacer, thus requiring additional time spent placing the bars in each spacer. The spacer disclosed in the '604 patent also limits the placement of vertically oriented reinforcing bars to the specific locations of the spacer and thereby requires that a spacer must be placed at each location in the form where a vertically oriented section of reinforcing bar is required.

Another device for supporting horizontally oriented reinforcing bars in a foundation footing form is disclosed in U.S. Pat. No. 5,224,799, issued to Parker. The Parker patent discloses a castelated bracket that is used to maintain the spaced apart relationship of a pair of form side walls of a footing form. While the device disclosed therein does make provisions for dimpled areas for supporting reinforcing bar, the device does not have means for securing the reinforcing bar in the dimpled areas. The Parker patent also does not disclose any device having guide members for directing reinforcing bar to a desired location, nor does it disclose a device for securing vertically oriented reinforcing bars.

U.S. Pat. No. 1,616,977, issued to Koivu discloses clips attached to vertically oriented reinforcing bars in a form for concrete walls. The bars are placed through a plurality of clips that are attached to the form and the rod then holds the clips in the proper relationship to each other. The Koivu patent does not disclose a device that can be attached to sections of horizontally oriented reinforcing bar.

Thus a need exists for devices that can be used for securing vertically and horizontally oriented reinforcing bars in concrete forms that do not require sections of reinforcing bars to be placed in the form prior to insertion of such devices. An additional need exists for devices that can be used for vertically oriented reinforcing bars that does not require a supporting device for horizontally oriented bars at each location where a vertical bar is required.

DISCLOSURE OF THE INVENTION

Accordingly, it is an object of this invention to provide a device for supporting and securing horizontally oriented reinforcing bars in a concrete form such that the reinforcing bars can be placed in the form after the supporting and securing device has been placed in the form.

Another object of this invention is to provide devices for supporting and securing horizontally oriented reinforcing bars in a form for concrete that do not require exacting placement of the bars into the device.

It is a further object of this invention to provide a device that can be used for securing vertically oriented reinforcing bars in a form for concrete that does not require a device for supporting horizontally oriented bars be located at each point where a vertical bar is required.

Yet another object of the current invention is to provide such devices that are relatively inexpensive and easy to store.

The current invention meets the above objects and overcomes the disadvantages of the prior art by disclosing a device for supporting horizontally oriented reinforcing bars in a form for concrete and a device for supporting vertically oriented reinforcing bars.

The device for supporting horizontally oriented reinforcing bars that is disclosed in this invention can be placed on the side walls of foundation footing forms. The device has ends that are configured for engaging the side walls and holding the device securely in position. The body of the device spans the distance between the form side walls and remains inside of the form below the top edge of the form such that the majority of the device will be covered by concrete when the form is filled.

In some instances, horizontal reinforcing bar can be placed in the device by simply putting the reinforcing bar on a guide member and releasing it. The reinforcing bar will then slide along the guide member and into the reinforcing bar holding area. Retention members prevent the reinforcing bar from floating up and out of the device when concrete is poured into the form. The device also provides support to the form side walls to prevent displacement of the side walls due to hydrostatic pressure when concrete is poured into the form.

The device for supporting vertically oriented reinforcing bars that is disclosed in this invention can be used at any location where vertical reinforcing bar is required and two parallel sections of horizontal reinforcing bar are present. The device used to secure a generally L-shaped section of reinforcing bar in a form such that portions of L-shaped section are engaged with or supported by the device. In use, the device is fastened to two sections of horizontal reinforcing bar. The vertical reinforcing bar is thus held firmly in position by the device and the device is covered by concrete that is poured into the form.

The devices disclosed herein can be made from rods or wires having sufficient dimensions and material properties to provide the desired support. The devices can be constructed from any material having properties that make the material satisfactory for use with concrete and provide sufficient strength to support the form side walls against deformation under hydrostatic pressure.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

FIG. 1 is an elevated perspective view of a foundation footing form with embodiments of a device for securing horizontally oriented reinforcing bar and vertically oriented reinforcing bars within the form as disclosed herein.

FIG. 2 is a perspective view of an embodiment of a device for securing vertically oriented reinforcing bar within a form for concrete as disclosed herein.

BEST MODE OF CARRYING OUT THE INVENTION

Figure 3:
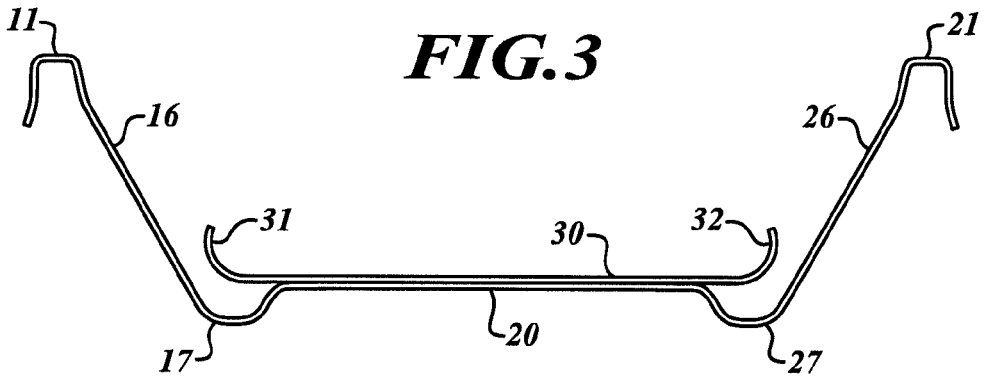
FIG. 3 shows an embodiment of a device for securing horizontally oriented reinforcing bars in a form for concrete as disclosed herein.

Turning now to the drawings, the invention will be described in a preferred embodiment by reference to the numerals of the drawing figures wherein like numbers indicate like parts.

FIG. 1 shows a form having a pair of substantially planar side walls 1 & 2. An embodiment of the horizontal reinforcing bar supporting device 10 is mounted on the side walls to support and secure two parallel sections of horizontal reinforcing bar 3 & 4 in the form. As can be seen in FIG. 1, the horizontal reinforcing bar supporting device rests on the top edges of the side walls, and is located well within the form so that it secures the horizontal reinforcing bar in the desired location within the form to insure adequate coverage of the horizontal reinforcing bar sections by concrete.

The majority of the horizontal reinforcing bar supporting device will be covered by concrete when it is poured into the form, and the device may provide a small amount of additional reinforcement to the concrete after it has cured. The horizontal reinforcing bar supporting device 10 also provides support to the side walls 1 & 2 to resist deformation of the side walls under hydrostatic pressure when concrete is poured into the form.

An embodiment of the vertical reinforcing bar securing and supporting device 40 secures an L-shaped section of reinforcing bar within the form. The long stem of the L-shaped section will protrude from the foundation footing when the concrete has cured, and it is used to provide a connection between the footing and the structure that will ultimately sit upon the footing.

Referring to FIG. 2 and to FIG. 1, the depicted embodiment of the vertical reinforcing bar supporting device 40 is placed over an L-shaped section of reinforcing bar such that the long stem 5 of the L-shape is routed through the reinforcing bar engaging loops 61 & 62 that extend from the vertical reinforcing bar support member 60, which extends upward from the base member 44. The base 6 of the L-shape is routed such that a generally U-shaped portion of the guide member 41 rests on the short stem.

The base member 44 has an end 45 that is generally U-shaped and configured for engaging the vertical reinforcing bar section. The end 45 is placed over the section of reinforcing bar such that the opening of the U-shape faces back toward the center of the form, and the lower leg 46 of the U is beneath the reinforcing bar section. In the embodiment depicted, the end 47 of the lower leg 46 is gently curved downward to assist in guiding the end of the member over the reinforcing bar section. Additionally, the depicted embodiment shows that the opening at the top of the U is narrower than the space at the base of the U to assist in securing the device to the reinforcing bar section.

A pair of connection members 50 & 55 extend from the side of the guide member 41 opposite the base member 44. The connection members each extend at an angle from the guide member and have ends 51 & 56 that are configured to engage a second section of horizontal reinforcing bar 4. The ends 51 & 56 are generally U-shaped and oriented such that when the device is in use, the openings of the U face downward.

In the embodiment depicted, the outer legs (shown as 57 on member 55) of the ends have additional sections 53 & 58 that curve to the sides of the ends and inward such that they will be underneath the reinforcing bar section 4 when the device is in use. The ends 53 & 58 lock the connection members onto the section of reinforcing bar 4 and prevent rotational movement of the reinforcing bar or the reinforcing bar securing device in directions parallel to the form side walls.

Figure 8:
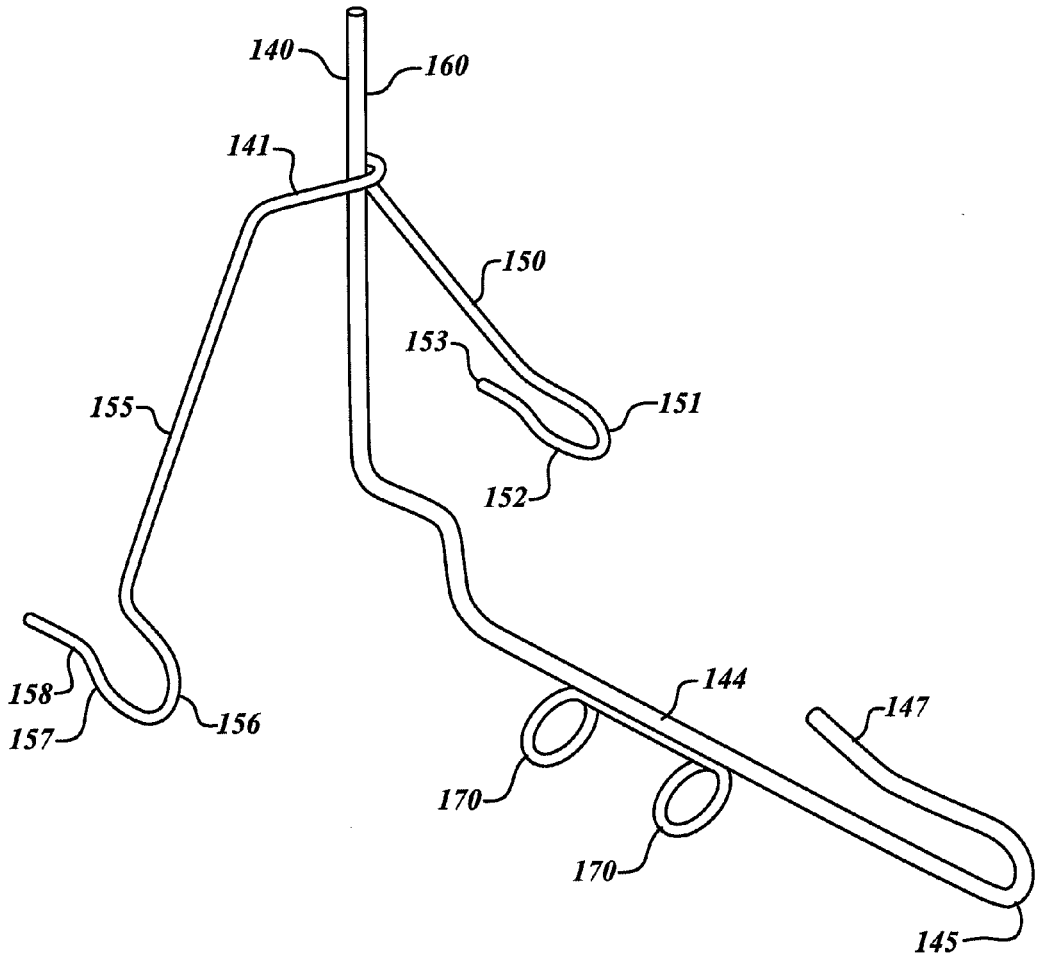
FIG. 8 shows an embodiment of a device for securing vertically oriented reinforcing bars as disclosed herein.
Figure 9:
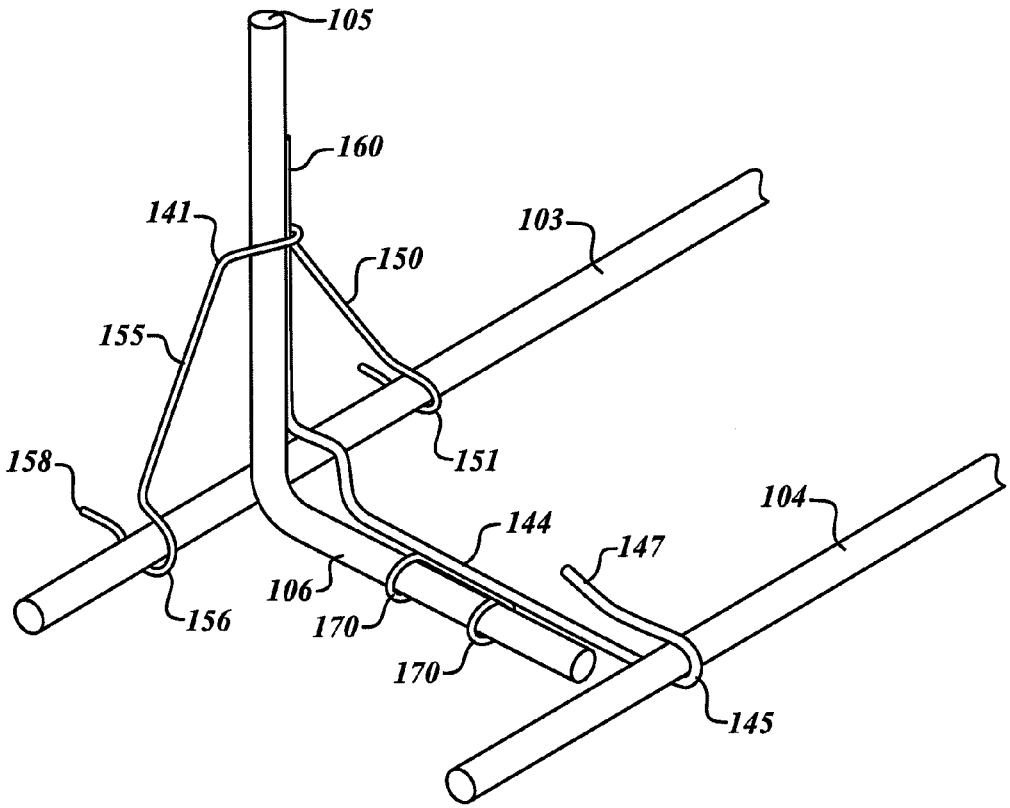
FIG. 9 shows the device depicted in FIG. 8 with a vertically oriented section of reinforcing bar secured therein.

FIGS. 8 and 9 show another embodiment of the device used for securing a generally L-shaped section of reinforcing bar within a form. The depicted embodiment of the vertical reinforcing bar supporting device 140 has a base member 144 with an end 145 that is configured for attachment to a section of horizontally oriented reinforcing bar. A vertical support member 160 extends from the end of the base member 144 that is opposite the reinforcing bar engaging end 145. The reinforcing bar engaging end 145 has a guide member for guiding the device onto a section of horizontal reinforcing bar. Additionally, the base member for the depicted embodiment is shaped such that the base member can rest on a section of horizontal reinforcing bar such that the vertical support member is directly above the horizontal reinforcing bar.

In this depicted embodiment, the guide member 141, having a generally U-shaped portion, is attached to the vertical support member. A pair of connection members 150 & 155 extend at an angle form the generally U-shaped portion of the guide member. The connection members 150 & 155 have ends 151 & 156 that are configured for attachment to a section of horizontal reinforcing bar. The reinforcing bar engaging ends 151 & 156 each have a guide member 153 & 158 for guiding the device onto a section of horizontal reinforcing bar.

The reinforcing bar engaging portion on this particular embodiment is a pair of reinforcing bar engaging loops 170 that are connected to the base member. In other embodiments, the reinforcing bar engaging portion can be a single loop or loops on both the base member and the vertical support member, and other embodiments use other configurations sufficient to secure the reinforcing bar to the device.

FIG. 9 shows the embodiment of the device depicted in FIG. 8 being used to secure an L-shaped section of reinforcing bar to two horizontal sections of reinforcing bar. The device is secured to the horizontal sections of reinforcing bar by the ends 145, 151 & 156. The end 145 of the base member 144 is attached to the horizontal reinforcing bar 104 such that the base member is routed below the horizontal reinforcing bar. The ends 151 & 156 of the guide member 141 are attached to the horizontal reinforcing bar section 103 such that the outer legs of the connection ends (depicted as 152 & 157 in FIG. 8) are routed underneath the reinforcing bar. The manner of connection of this embodiment of the device ensures that the device will not be disconnected from the horizontal reinforcing bar when concrete is poured into the form.

The device is connected to the horizontal reinforcing bar sections such that the vertical support member 160 is directly above a reinforcing bar section. The long stem 105 of the L-shaped section of reinforcing bar is routed through the U-shaped portion of the device. The L-shaped section of reinforcing bar is placed in the reinforcing bar engaging loops 170 such that the base 106 of the L is supported along the base member by the loops.

In use, sections of reinforcing bar that are generally L-shaped can be placed in the devices either before it is connected to the horizontal reinforcing bar or after it is connected to the horizontal reinforcing bar. The devices for securing vertical sections of reinforcing bar, are connected to horizontal sections of reinforcing bar at desired locations in a forms for concrete such that the long stem of the L extends vertically from the form.

Concrete is then poured into the form and after it has cured, the vertically oriented sections of reinforcing bar that protrude from the cured concrete are used to support additional structure that rests on the cured concrete. When concrete is poured into the form, the device is entirely covered and remains in the concrete structure after it has cured. FIG. 3 shows an embodiment of the device for securing horizontal reinforcing bar in a foundation footing form. The device has a pair of attachment ends 11 & 21 that are configured for placement over the side walls of a foundation footing form. A pair of reinforcing bar guide members 16 & 26 extend at a downward angle into the form to a horizontal cross member 20. The horizontal cross member 20 spans the distance between the guide members 16 & 26. The cross member 20 is shaped such that portions of the cross member 17 & 27 are lower than the body of the member. The low portions of the cross member are reinforcing bar support portions 17 & 27. In the embodiment depicted, a reinforcing bar retention member 30 is connected to the top of the horizontal cross member for securing reinforcing bar in the reinforcing bar support portions.

Figure 4:
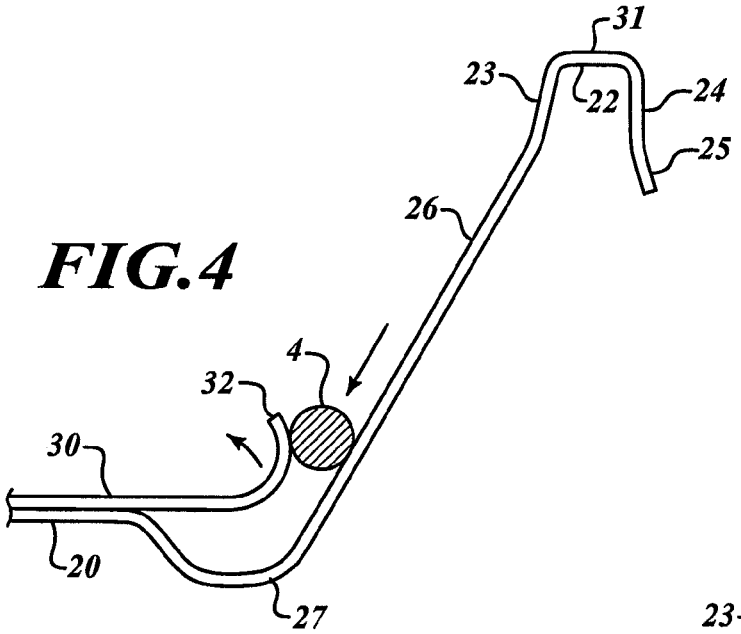
FIG. 4 shows a section of reinforcing bar being placed on the device of FIG. 3.
Figure 5:
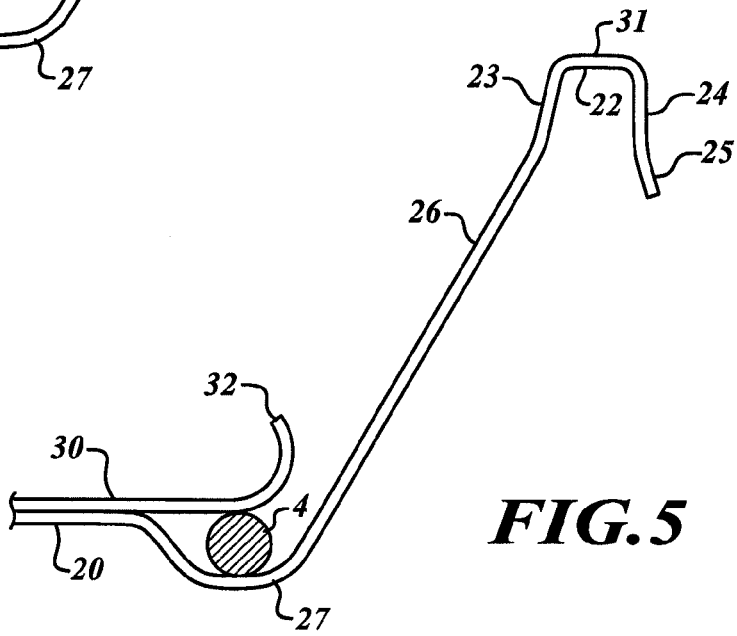
FIG. 5 shows a section of reinforcing bar secured in the device of FIG. 3.

Referring now to FIGS. 3 and 4 for a more detailed description of the device depicted in FIG. 3. While the description is directed to the right side of the device as depicted, both sides function identically and have identical elements. The side wall attachment end 21 of the device is a generally U-shaped portion having a base member 22, an inside leg 23, and an outside leg 24. The distance between the two legs is complimentary to the dimensions of materials that are generally used for footing forms such that the end will be frictionally engaged with the form side wall when it is in use.

In use, the base member 22 rests on the top edge of the form side wall, and the out side leg 24 rests on the outside of the side wall, while the inside leg 25 rests on the inside wall of the form. In the embodiment depicted, the end 25 of the outside leg 24 is bent slightly outward to assist in guiding the end 21 onto the side wall. While not shown in the figures, some embodiments of the device can include notches on the base member 22 so that these portions can be removed from the device after concrete has cured, thus allowing for easier removal of the form side walls from the cured footing.

The guide member 26 extends downward and inward toward the reinforcing bar holding portion 27. When the device is in use, a section of reinforcing bar can simply be placed against the guide member and released. The reinforcing bar section will slide downward along the guide member and into the reinforcing bar holding portion 27, where it will be prevented from floating out of the holding portion, during the concrete pour, by the reinforcing bar retention member 30. The end 32 of the reinforcing bar retention member is curved upward and inward to assist the guide member in directing reinforcing bar sections into the reinforcing bar holding portion.

Figure 6:
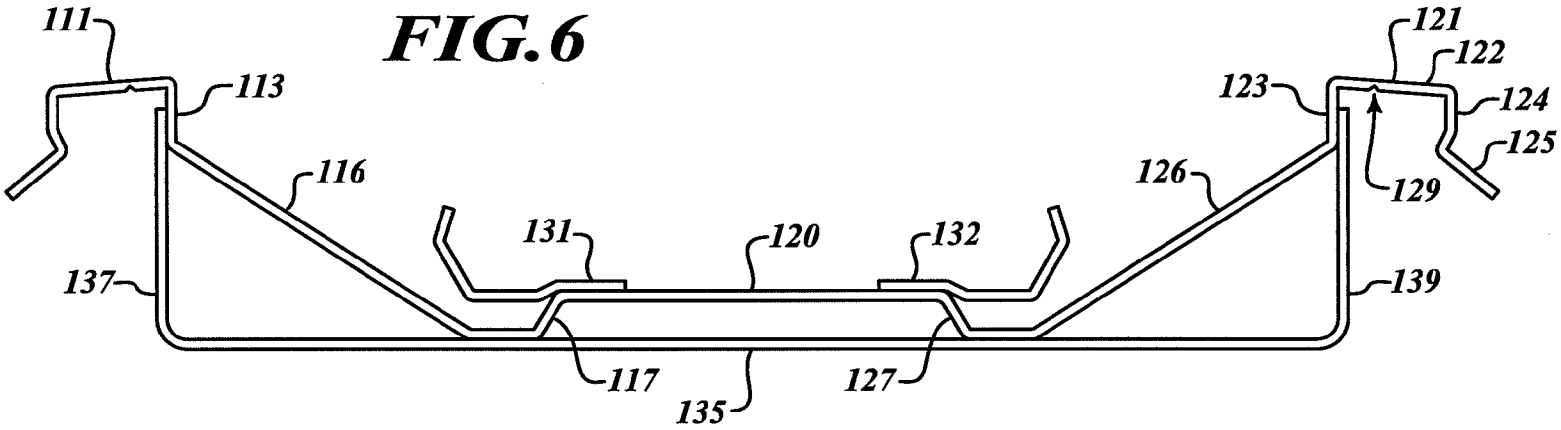
FIG. 6 shows an embodiment of a device for securing horizontally oriented reinforcing bars as disclosed herein.

FIG. 6 shows another embodiment of the device for securing horizontal reinforcing bar in a foundation footing form. The device has a pair of attachment ends 111 & 121 that are configured for placement over the side walls of a form. A pair of reinforcing bar guide members 116 & 126 extend at a downward angle into the form to a horizontal cross member 120. The horizontal cross member 120 spans the distance between the guide members 116 & 126. The cross member 120 is shaped such that portions of the cross member 117 & 127 are lower than the body of the member.

The low portions of the cross member are reinforcing bar support portions 117 & 127. In the embodiment depicted, a pair of reinforcing bar retention members 131 & 132 are connected to the top of the horizontal cross member for securing reinforcing bar in the reinforcing bar support portions. The ends of the retention members 131 &132 are configured to assist in guiding reinforcing bar into the reinforcing bar support portions when it is dropped onto the guide members 116 & 126.

While both attachment ends 111 & 121 function identically and have identical elements, the attachment ends will be described in detail by a description of one side 121 only. The side wall attachment end 121 of the device is a generally U-shaped portion having a base member 122, an inside leg 123, and an outside leg 124. The distance between the two legs is complimentary to the dimensions of materials that are generally used for footing forms such that the end will be frictionally engaged with the form side wall when it is in use.

In use, the base member 122 rests on the top edge of the form side wall, and the outside leg 124 rests on the outside of the side wall, while the inside leg 125 rests on the inside wall of the form. In the embodiment depicted, the end 125 of the outside leg 124 is bent slightly outward to assist in guiding the end 121 onto the side wall. A notch 129 on the base member 122 allows most of the attachment end to be removed from the device after concrete has cured, thus allowing for easier removal of the form side walls from the cured footing.

The depicted embodiment also has a form support member with a horizontally oriented support bar 135 and a pair of side wall engaging legs 137 & 139 extending upward from the ends of the support bar 135. The support bar 135 is connected to the bottom of the cross member 120 at the reinforcing bar supporting portions 117 & 127. The support member is also connected to the inside legs 113 & 123 of the reinforcing bar engaging ends of the device.

When the device depicted in FIG. 6 is used on a form, the outside legs of the attachment ends assist in holding the side walls in place against the hydrostatic pressure of concrete poured into the form. Additionally, the support member resists inward pressure thereby maintaining the spaced apart relationship of the form side walls.

Figure 7:
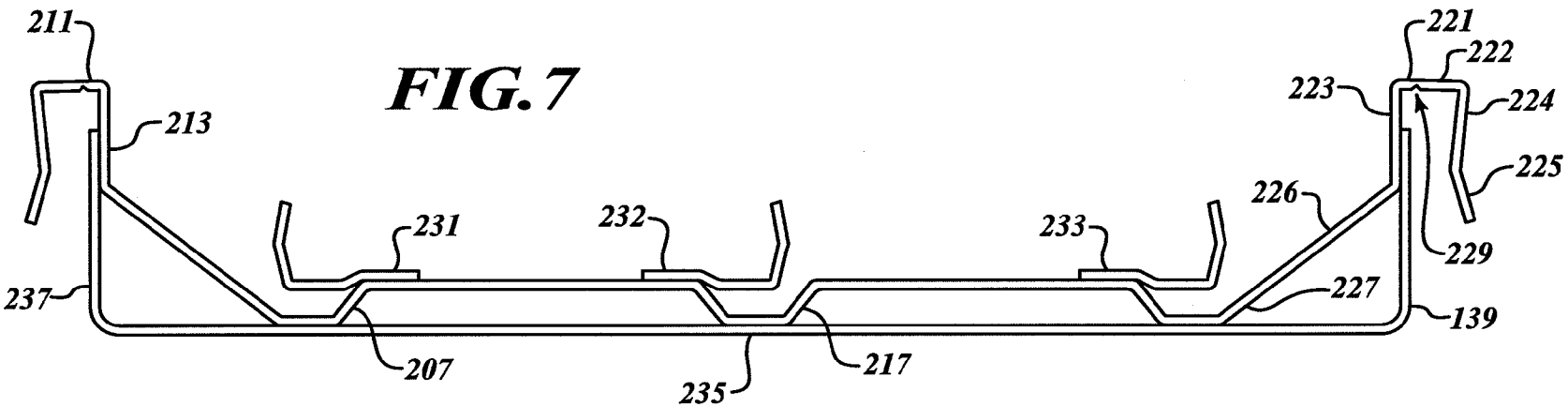
FIG. 7 shows an embodiment of a device for securing horizontally oriented reinforcing bars as disclosed herein.

FIG. 7 shows yet another embodiment of the device for securing horizontal reinforcing bar in wider foundation footing forms, or for use where additional sections of horizontal reinforcing bar is desired. The device has a pair of attachment ends 211 & 221 that are configured for placement over the side walls of a form. A pair of reinforcing bar guide members 216 & 226 extend at a downward angle into the form to a horizontal cross member 120. The horizontal cross member 220 spans the distance between the guide members 216 & 226. The cross member 120 of this embodiment is shaped such that three portions of the cross member 207, 217 & 227 are lower than the body of the member, thus creating three reinforcing bar support portions.

In the embodiment depicted, three reinforcing bar retention members 231, 232 & 233 are connected to the top of the horizontal cross member for securing reinforcing bar in the reinforcing bar support portions. The ends of the retention members are configured to assist in guiding reinforcing bar into the reinforcing bar support portions.

While both attachment ends 211 & 221 function identically and have identical elements, the attachment ends will be described in detail by a description of one side 221 only. The side wall attachment end 221 of the device is a generally U-shaped portion having a base member 222, an inside leg 223, and an outside leg 224. The distance between the two legs is complimentary to the dimensions of materials that are generally used for footing forms such that the end will be frictionally engaged with the form side wall when it is in use. In use, the base member 222 rests on the top edge of the form side wall, and the outside leg 224 rests on the outside of the side wall, while the inside leg 225 rests on the inside wall of the form. In the embodiment depicted, the end 225 of the outside leg 224 is bent slightly outward to assist in guiding the end 221 onto the side wall. A notch 229 on the base member 222 allows most of the attachment end to be removed from the device after concrete has cured, thus allowing for easier removal of the form side walls from the cured footing.

The depicted embodiment also has a form support member with a horizontally oriented support bar 235 and a pair of side wall engaging legs 237 & 239 extending upward from the ends of the support bar 235. The support bar 235 is connected to the bottom of the cross member 220 at the reinforcing bar supporting portions 207, 217 & 227. The support member is also connected to the inside legs 213 & 223 of the reinforcing bar engaging ends of the device.

When the device depicted in FIG. 7 is used on a form, the outside legs of the attachment ends assist in holding the side walls in place against the hydrostatic pressure of concrete poured into the form. Additionally, the support member resists inward pressure thereby maintaining the spaced apart relationship of the form side walls.

While shown in the drawings with only one section of reinforcing bar in the support portions, the reinforcing bar support portions of the devices are of sufficient size to accommodate at least two sections of reinforcing bar where two sections are together (i.e., at overlapping joints of reinforcing bar sections, etc.).

In use, the horizontal reinforcing bar holding devices disclosed herein are placed on the side walls of a foundation footing form at desired intervals. Horizontal sections of reinforcing bar are then placed into the form. In some cases, the reinforcing bar can simply be dropped onto the guide members and it will be guided into the reinforcing bar support portions by the guide members and the ends of the reinforcing bar retention members. In cases where there is no guide member next to a support portion, the reinforcing bar must be inserted by hand. If vertical reinforcing bar sections are required, the vertical reinforcing bar device is place over an L-shaped section of reinforcing bar and secured to the horizontal reinforcing bar as described above.

When concrete is poured into the form, the reinforcing bar retention members prevent the horizontal reinforcing bar from floating out of the reinforcing bar holding portions. The outside legs of the attachment ends assist in holding the side walls in place against the hydrostatic pressure of concrete poured into the form and if the device has support members, they resist any inward pressure thereby maintaining the spaced apart relationship of the form side walls.

After the concrete has cured, the devices disclosed herein remain within the cured structure. The protruding portions of the attachment ends can be removed to aid in removal of the form side walls from the cured structure. If sections of vertically oriented reinforcing bar are protruding from the form, they can be used to provide reinforcement for the structure that is placed on top of the cured concrete.

The devices disclosed herein can be made from rods or wires having sufficient dimensions and material properties to provide the desired support. The devices can be constructed from any material having properties that make the material satisfactory for use with concrete and provide sufficient strength to support the form side walls against deformation under hydrostatic pressure.

INDUSTRIAL APPLICABILITY

The invention has applicability in the field of construction using concrete. In particular the current invention describes devices that are used for securing vertical and horizontal reinforcing bar in forms for concrete. One of the devices disclosed has retention members to prevent horizontal reinforcing bar from floating out of the device when concrete is poured into the form. Another of the devices disclosed can be used to secure vertical reinforcing bar in a form without the need for a horizontal reinforcing bar support.

These devices are generally used for foundation footing forms, but they can be used for other forms as well. Therefore, the devices have applicability in the field of residential and non-residential building construction.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A device for securing horizontally oriented reinforcing bars in a form that has a pair of substantially planar side walls defining a form interior for the placement of concrete, each of the side walls having a top edge and a bottom edge, the device comprising:

a pair of side wall attachment ends;

the side wall attachment ends each being a generally U-shaped portion having an inside leg, a base member, and an outside leg such that when the device is in use, the base members rest on the top edge of the form side walls, the outside legs are on the outside of the form side walls, and the inside legs are on the inside of the form side walls;

a pair of reinforcing bar guide members;

the reinforcing bar guide members each extending from the inside leg of one of the attachment ends such that when the attachment ends are placed on the form side walls, the reinforcing bar guide members extend down into the form at an angle towards the interior of the form;

a horizontal cross member;

the horizontal cross member extending between the guide members such that when the device is attached to the form, the cross member spans the space between the guide members at a predetermined distance above the substrate beneath the form;

the cross member having at least two reinforcing bar support portions, the reinforcing bar support portions being portions of the cross member that are shaped such that they are slightly lower than the remainder of the cross member when the device is attached to a form, the support portions being configured to accommodate at least two sections of horizontally oriented reinforcing bar that intersects the device at a generally right angle;

at least one reinforcing bar retention member;

the reinforcing bar retention member being attached to the cross member and having at least one end that extends over a reinforcing bar support portion of the cross member;

a form support member, the form support member having a support bar with side wall engaging legs extending from each end of the support bar, the support bar being connected to the portion of the cross member that would be the bottom of the cross member when the device is attached to a form, and one of said side wall engaging legs connected to each of the attachment ends such that when the device is attached to a form, the side wall engaging legs extend downward into the form while contacting the side walls along the length of the side wall engaging legs;

wherein the device is notched on the side wall attachment ends at the point where the base member and the inside leg intersect such that the base member and the outside leg can be removed after concrete has been poured into a form and allowed to harden whereby when the device is placed on the side walls of a foundation footing form, the guide members will guide horizontally oriented reinforcing bars into reinforcing bar support portions, the reinforcing bar retention member will prevent the reinforcing bars from being displaced when concrete is poured into the form; and the device will provide lateral bracing for the side walls against the hydrostatic pressure exerted on the side walls by the liquid concrete.

2. The device of claim 1 wherein the side wall attachment ends are configured to fit tightly over the top edge of the side walls thereby securing the device into frictional engagement with the side walls.

3. The device of claim 1 wherein the cross member has at least two reinforcing bar support portions one being located at each end of the cross member at the points where the cross member and the guide members intersect, the support portions shaped such that at least two sections of reinforcing bar, that are oriented at a right angle to the cross member, can be placed in each support portion.

4. The device of claim 3 wherein the cross member has more than two reinforcing bar support portions.

5. The device of claim 1 wherein the at least one end or the reinforcing bar retention member, that extends over the reinforcing bar support portion, is curved upward.

6. A device for securing horizontally oriented reinforcing bars in a form that has a pair of substantially planar side walls defining a form interior for the placement of concrete, each of the side walls having a top edge and a bottom edge, the device comprising:

a pair of side wall attachment ends;

the side wall attachment ends each being a generally U-shaped portion having an inside leg, a base member, and an outside leg such that when the device is in use, the base members rest on the top edge of the form side walls, the outside legs are on the outside of the form side walls, and the inside legs are on the inside of the form side walls;

a pair of reinforcing bar guide members;

the reinforcing bar guide members each extending from the inside leg of one of the attachment ends such that when the attachment ends are placed on the form side walls, the reinforcing bar guide members extend down into the form at an angle towards the interior of the form;

a horizontal cross member;

the horizontal cross member extending between the guide members such that when the device is attached to the form, the cross member spans the space between the guide members at a predetermined distance above the substrate beneath the form;

the cross member having at least two reinforcing bar support portions, the reinforcing bar support portions being portions of the cross member that are shaped such that they are slightly lower than the remainder of the cross member when the device is attached to a form, the support portions being configured to accommodate at least two sections of horizontally oriented reinforcing bar that intersects the device at a generally right angle;

at least one reinforcing bar retention member;

the reinforcing bar retention member being attached to the cross member and having at least one end that extends over a reinforcing bar support portion of the cross member;

a form support member, the form support member having a support bar with side wall engaging legs extending from each end of the support bar, the support bar being connected to the portion of the cross member that would be the bottom of the cross member when the device is attached to a form, and one of said sidewall engaging legs connected to each of the attachment ends such that when the device is attached to a form, the side wall engaging legs extend downward into the form while contacting the side walls along the length of the side wall engaging legs;

wherein the end of the outside legs of the side wall engaging ends opposite the base member is bent slightly outward such that it assists in guiding the side wall engaging ends onto the form side walls;

whereby when the device is placed on the side walls of a foundation footing form, the guide members will guide horizontally oriented reinforcing bars into reinforcing bar support portions, the reinforcing bar retention member will prevent the reinforcing bars from being displaced when concrete is poured into the form; and the device will provide lateral bracing for the side walls against the hydrostatic pressure exerted on the side walls by the liquid concrete.

7. The device of claim 6 wherein the side wall attachment ends are configured to fit tightly over the top edge of the side walls thereby securing the device into frictional engagement with the side walls.

8. The device of claim 6 wherein the cross member has at least two reinforcing bar support portions one being located at each end of the cross member at the points where the cross member and the guide members intersect, the support portions shaped such that at least two sections of reinforcing bar, that are oriented at a right angle to the cross member, can be placed in each support portion.

9. The device of claim 8 wherein the cross member has more than two reinforcing bar support portions.

10. The device of claim 6 wherein the at least one end or the reinforcing bar retention member, that extends over the reinforcing bar support portion, is curved upward.

* * * * *